US006955017B2

(12) United States Patent
Hilburn

(10) Patent No.: US 6,955,017 B2
(45) Date of Patent: Oct. 18, 2005

(54) FIRE BARRIER TRANSITIONS

(75) Inventor: Johnnie D. Hilburn, Wichita, KS (US)

(73) Assignee: Balco, Inc., Wichita, KS (US)

( * ) Notice: Subject to any disclaimer, the term of this patent is extended or adjusted under 35 U.S.C. 154(b) by 0 days.

(21) Appl. No.: 10/288,895

(22) Filed: Nov. 5, 2002

(65) Prior Publication Data

US 2004/0083668 A1 May 6, 2004

(51) Int. Cl.[7] ..... E04B 1/68
(52) U.S. Cl. ..... 52/396.04; 52/656.2
(58) Field of Search ..... 52/396.04, 717.06, 52/393, 656.2, 656.3, 656.4, 656.5, 656.6

(56) References Cited

U.S. PATENT DOCUMENTS

| | | | | |
|---|---|---|---|---|
| 749,118 | A * | 1/1904 | Walbridge | 52/656.2 |
| 2,419,648 | A * | 4/1947 | Koontz | 52/800.14 |
| 3,659,390 | A | 5/1972 | Balzer et al. | |
| 4,566,242 | A | 1/1986 | Dunsworth | |
| 5,263,293 | A | 11/1993 | Gohlke et al. | |
| 5,875,598 | A | 3/1999 | Batten et al. | |
| 5,974,750 | A | 11/1999 | Landin et al. | |
| 6,112,488 | A | 9/2000 | Olson et al. | |
| 6,128,874 | A * | 10/2000 | Olson et al. | 52/232 |
| 6,131,352 | A * | 10/2000 | Barnes et al. | 52/396.01 |
| 6,751,919 | B2 * | 6/2004 | Calixto | 52/573.1 |

OTHER PUBLICATIONS

Balco Catalog; p. 3 and p. 18, date unknown.

* cited by examiner

*Primary Examiner*—Milton Nelson, Jr.
(74) *Attorney, Agent, or Firm*—Hovey Williams LLP

(57) ABSTRACT

A fire barrier transition (10,110,210,310) comprises a first section (130,230,330) to mate with a first fire barrier (14) in a first expansion joint (16), a second section (132,232,332) to mate with a second fire barrier (18) in a second expansion joint (20), and a center section (134,234,334) therebetween to seal a gap (12) between the barriers (14,18). The first section (130,230,330) and the second section (132,232,332) each present either a convex or a concave cross-section with two sidewalls (136,236,336) and a bight section (138,238,338) therebetween. Thus, the transition (10,110,210,310) preferably presents a specific shape with the first section (130,230,330) and the second section (132,232,332) each presenting channels aligned at an angle between the joints (16,20). The barriers (14,18) can slide between the sidewalls (136,236,336) and engage the bight sections (138,238,338), thereby mating with and sealing to the first section (130,230,330) and the second section (132,232,332).

17 Claims, 5 Drawing Sheets

FIRE BARRIER TRANSITIONS

BACKGROUND OF THE INVENTION

1. Field of the Invention

The present invention relates to fire barriers for expansion joints. More particularly, the present invention relates to a fire barrier transition for expansion joints that is prefabricated to fill a gap between fire barriers where two joints meet.

2. Description of Prior Art

Fire barrier material is commonly installed in expansion joints in an effort to prevent the spread of fire. However, gaps are typically left where two joints meet, particularly where joints meet at angles. This can be attributed to the material itself, since such material may not be able to readily conform to such angles without bunching up or ripping.

As a result, installers are often forced to leave gaps exposed which increase the risk of the spread of fire. This essentially negates the purpose of installing fire barriers and may violate building construction codes.

Alternatively, installers may cut and form material into shapes capable of sealing such gaps. However, it can be labor intensive to precisely cut and form such complex shapes and, even with care, gaps may still exist. Additionally, cutting and forming material in the field during installation can lead to other inefficiencies, such as material waste.

Accordingly, there is a need for an improved fire barrier transition that overcomes the limitations of the prior art.

SUMMARY OF THE INVENTION

The present invention overcomes the above-identified problems and provides a distinct advance in the art of fire barriers for expansion joints. More particularly, the present invention provides a fire barrier transition for expansion joints that is preferably prefabricated to fill a gap between two fire barriers where two expansion joints meet at an angle. The transition is preferably made from a flexible fire resistant material that is preferably multilayered and comprises an expanding fire paper layer, a ceramic fiber layer, and an insulating cloth layer.

The material must be operable to span the joints and is preferably cut to a width slightly wider than the joints. The material is also preferably cut to a length sufficient to allow the transition to overlap the barriers, by at least ten inches, in order to effectively seal the gap and accommodate movement between the joints. The length is preferably calculated by doubling a maximum depth at which the barriers will be placed and then adding sufficient length to allow for a ten inch overlap.

A first embodiment of the transition broadly comprises a first section to mate with a first barrier, a second section to mate with a second barrier, and a center section therebetween to seal the gap between the barriers. The first section and the second section each preferably present a concave cross-section with two sidewalls and a bight section therebetween. Thus, the transition preferably presents a specific first shape with the first section and the second section each preferably presenting channels aligned at the angle at which the joints meet. The barriers can slide between the sidewalls and engage the bight sections of the first section and the second section, thereby mating with and sealing to the first section and the second section.

While the material is flexible, it is typically not flexible enough to accommodate the first shape described above, without bunching up and/or ripping. Thus, the center section must be adapted to accommodate the first shape. A preferred method of adapting the center section requires cutting the material near a longitudinal center with two inward cuts. Each inward cut is made from opposing longitudinal edges and substantially perpendicular to the longitudinal edges. The inward cuts preferably leave a middle portion of the center section whole and continuous. The middle portion preferably aligns with the bight sections and is preferably approximately as wide as a widest one of the joints. Thus, each inward cut is preferably approximately one half of the difference between the width of the material and the widest one of the joints.

The sidewalls are defined by the inward cuts and comprise portions of the material adjacent the longitudinal edges extending inwardly for a width substantially equal to the length of the inward cuts. All four sidewalls are preferably folded in a common direction, such that the material presents a unitary channel structure. Then, the first section is folded toward the second section adjacent the inward cuts. Once the first section is aligned with the second section at the angle at which the joints meet, portions of the sidewalls adjacent the inward cuts are preferably affixed together, such that the transition may hold the first shape.

A second embodiment of the transition broadly comprises a first section to mate with the first barrier, a second section to mate with the second barrier, and a center section therebetween to seal the gap between the barriers. The first section and the second section each preferably present a convex cross-section with two sidewalls and a bight section therebetween. It can be seen that the second embodiment of the transition is similar to the first embodiment of the transition. The most obvious difference is that the first section and the second section of the second embodiment present convex cross-sections, and thus, a specific second shape.

A preferred method of adapting the center section to accommodate the second shape requires cutting the material near a longitudinal center with two inward cuts. Each inward cut is made from opposing longitudinal edges and substantially perpendicular to the longitudinal edges. The inward cuts preferably leave a middle portion of the center section whole and continuous. The middle portion preferably aligns with the bight sections and is preferably approximately as wide as the widest one of the joints. Thus, each inward cut is preferably approximately one half of the difference between the width of the material and the widest one of the joints.

Additionally, one of two longitudinal cuts is preferably made adjacent each inward end of the inward cuts. The longitudinal cuts are preferably substantially centered on the inward ends and substantially parallel to the longitudinal edges. The longitudinal cuts are preferably approximately twice as long as the inward cuts.

The sidewalls are defined by the inward cuts and comprise portions of the material adjacent the longitudinal edges extending inwardly for a width substantially equal to the length of the inward cuts. All four sidewalls are preferably folded in a common direction, such that the material presents the unitary channel structure, similar to the first embodiment of the transition. Then, the first section is folded away from the second section adjacent the inward cuts until a rear surface of the first section meets a rear surface of the second section. At this point, the material is in the shape of two parallel and opposing convex channels meeting at their bight sections. The material is preferably affixed adjacent opposing pairs of ends of the longitudinal cuts, which should substantially meet.

It should be apparent that this creates a tab between the first section and the second section. While the tab preferably remains with the transition, the tab may be removed from the transition. If the tab is removed, the middle portion of the center section may not be completely continuous. In this case, the middle portion of the center section must rely on the manner in which the material is affixed adjacent the ends of the longitudinal cuts, in order to effectively seal the gap.

Then, the first section is folded toward the second section adjacent the ends of the longitudinal cuts. Once the first section is aligned with the second section at the angle at which the joints meet, portions of the sidewalls adjacent the inward cuts are preferably affixed together, such that the transition may hold the second shape.

A third embodiment of the transition broadly comprises a first section to mate with the first barrier, a second section to mate with the second barrier, and a center section therebetween to seal the gap between the barriers. The first section preferably presents a convex cross-section with two sidewalls and a bight section therebetween. The second section preferably presents a concave cross-section with two sidewalls and a bight section therebetween. Thus, the third embodiment of the transition presents a specific third shape, which combines characteristics of the first embodiment and the second embodiment of the transition.

A preferred method of adapting the center section to accommodate the third shape requires cutting the material near a longitudinal center with two inward cuts. Each inward cut is made from opposing longitudinal edges at an approximately forty-five degree angle to the longitudinal edges starting near the first section and progressing inwardly toward the second section. The inward cuts preferably leave a middle portion of the center section whole and continuous. The middle portion preferably aligns with the bight sections and is preferably approximately as wide as the widest one of the joints. Thus, each inward cut is preferably approximately one half of the difference between the width of the material and the widest one of the joints multiplied by 1.414, which is the inverse of the cosine of the forty-five degree angle.

The sidewalls are defined by the inward cuts and comprise portions of the material adjacent the longitudinal edges extending inwardly for a width substantially equal to the length of the inward cuts divided by 1.414. The sidewalls of the first section are preferably folded in a first direction, while the sidewalls of the second section are preferably folded in a second direction, opposite to the first direction, such that the material presents two channel structures aligned end-to-end and opposed. Then, the first section is folded toward the second section adjacent the inward cuts. Once the first section is aligned with the second section at the angle at which the joints meet, the portions of the sidewalls adjacent the inward cuts are preferably affixed together, such that the transition may hold the third shape.

In use, an installer may mate the transition to the barriers before installing the barriers into the joints. In doing so, the installer may choose to secure the transition to the barriers using mechanical fasteners, adhesives, or stitching. However, the installer is not required to secure the transition to the barriers and may allow frictional resistance of the joints themselves to hold the transition in place. Alternatively, the installer may mate the transition to the barriers after the barriers have been installed in the joints.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
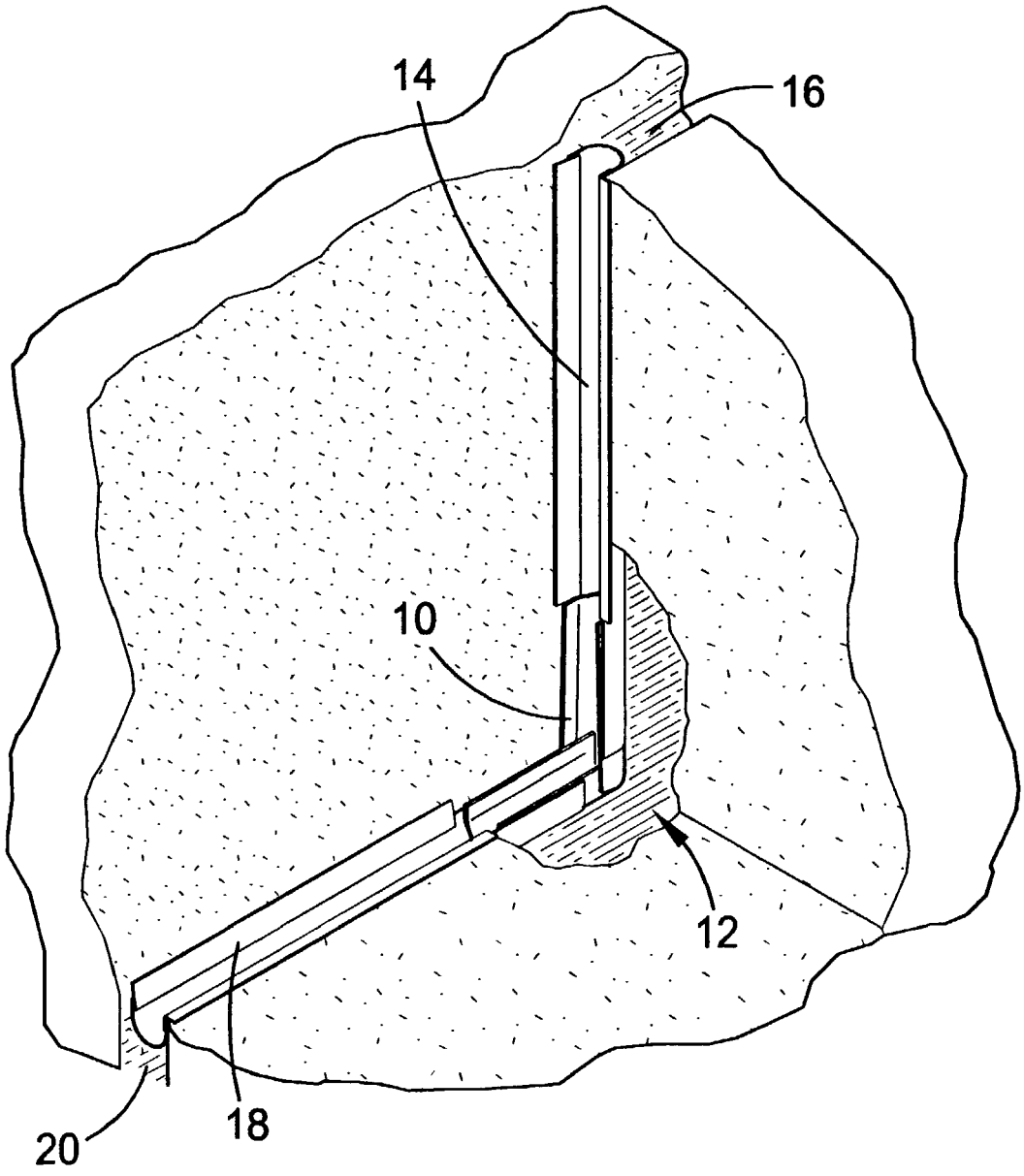
FIG. 1 is a perspective view of a fire barrier transition constructed in accordance with a preferred embodiment of the present invention shown sealing a gap between two fire barriers.

Referring to FIG. 1, the preferred fire barrier transition 10 constructed in accordance with the present invention is illustrated sealing a gap 12 between a first fire barrier 14 fitted into a first expansion joint 16 and a second fire barrier 18 fitted into a second expansion joint 20. Each barrier 14, 18 is preferably made of a fire resistant material that is able to prevent fire from spreading through the joints 16, 20. The barriers 14,18 are typically cut and otherwise sized to fit within and along the joints 16,20. However, the barriers 14,18 typically do not extend through areas where the joints 16,20 meet, thereby leaving the gap 12 between the barriers 18. This is particularly true where the joints 16,20 meet at an angle, such as where a wall expansion joint meets a floor expansion joint. Unless the gap 12 is sealed, fire may spread through the gap 12, thereby negating the purpose of the barriers 14,18.

Figure 2:
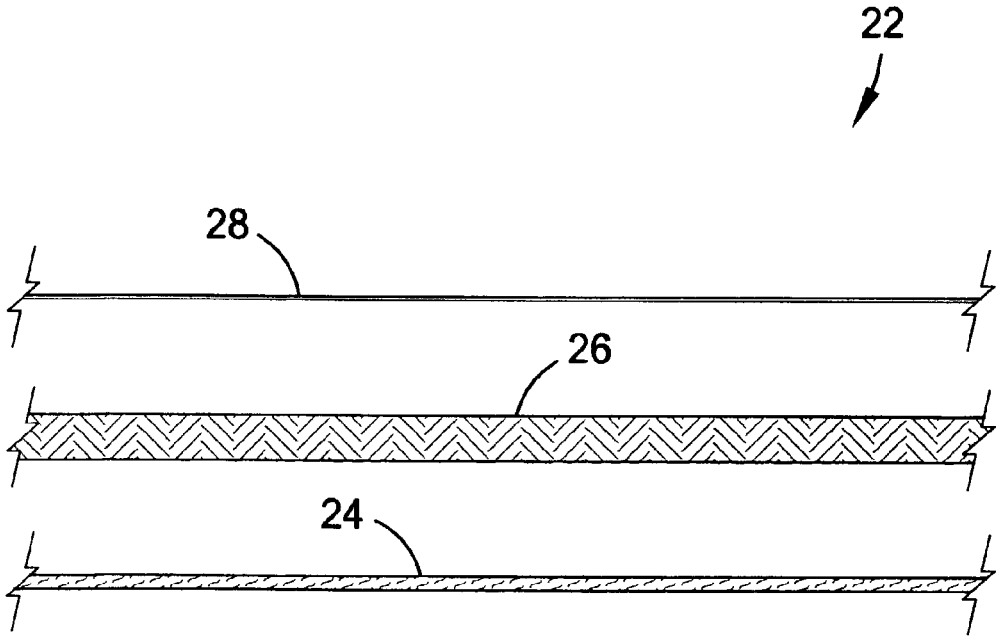
FIG. 2 is an exploded elevation view of material from which the transition is preferably constructed.

Therefore, the transition 10 is preferably designed to mate with each barrier 14,18 and be fitted into the joints 16,20 with the barriers 14,18, thereby sealing the gap 12 between the barriers 14,18. The transition 10 is preferably made from a flexible fire resistant material 22. As shown in FIG. 2, the material 22 is preferably multilayered and comprises an expanding fire paper layer 24, a ceramic fiber layer 26, and an insulating cloth layer 28. The expanding layer 24 is designed to expand and fill voids, when exposed to heat, and may be of the type available from Unifrax Corporation, such as Unifrax's XFP Expanding Fyre Paper. The ceramic layer 26 is designed to actively retard heat transfer by releasing chemically bound water and may be of the type available from 3M, Inc., such as 3M's Interam™ E-5 Series Mat. The cloth layer 28 is designed to passively retard heat transfer and may be of the type available from Newtex Industries, such as Newtex's Zetex 300 HT.

The material 22 must be operable to span the joints 16,20 and is preferably cut to a width slightly wider than the joints 16,20, assuming that the joints 16,20 are of similar widths. If the joints 16,20 are of different widths, then the width to which the material 22 is cut should be slightly wider than a widest one of the joints 16,20. For example, if the joints 16,20 are both approximately two inches wide, then the width to which the material 22 is cut is preferably between three inches and six inches. Alternatively, if the first joint 16 is approximately two inches wide and the second joint 20 is approximately three inches wide, then the width to which the material 22 is cut is preferably between four inches and ten inches.

The material 22 is also preferably cut to a length sufficient to allow the transition to overlap the barriers 14,18, by at least ten inches, in order to effectively seal the gap and accommodate movement between the joints 16,20. The length is preferably calculated by doubling a maximum depth at which the barriers 14,18 will be placed and then adding sufficient length to allow for a ten inch overlap. For example, if the barriers 14,18 are to be installed into twelve inch deep joints 16,20, then the barriers 14,18 are typically installed with an approximately eight inch depth. Thus, in the above example, the length may be approximately thirty-six inches, which is two times the eight inch depth plus two times the ten inch overlap.

Figure 4:
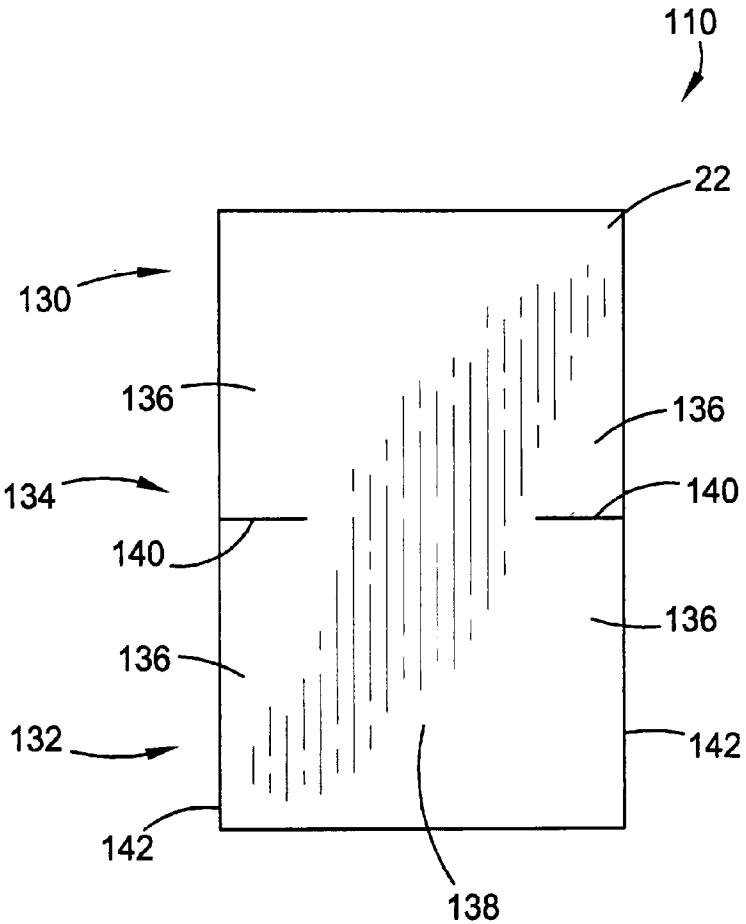
FIG. 4 is a plan view of a first piece of the material from which the first embodiment of the transition may be fabricated.
Figure 3:
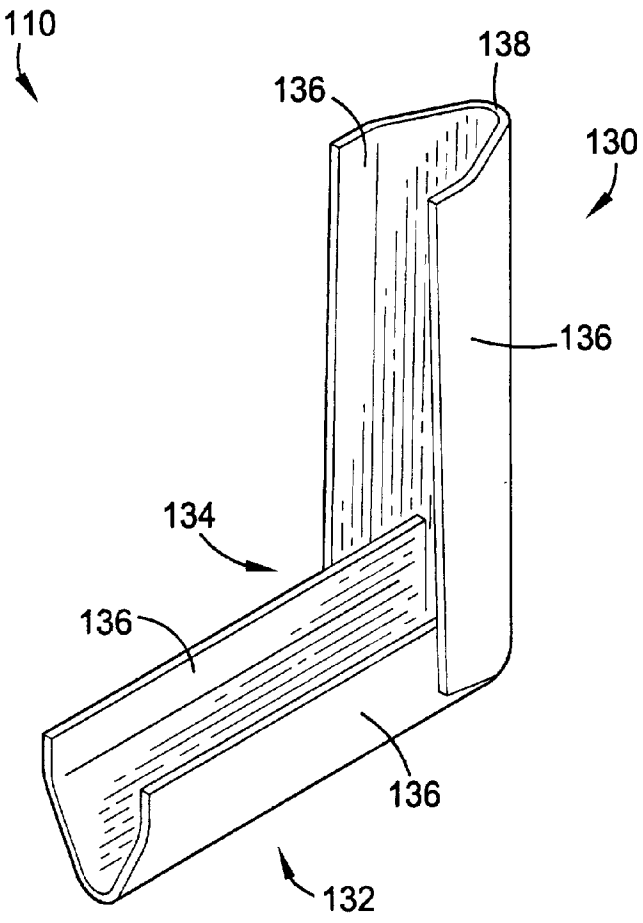
FIG. 3 is a perspective view of a first embodiment of the transition.

Referring also to FIGS. 3–4, a first embodiment of the transition 110 broadly comprises a first section 130 to mate with the first barrier 14, a second section 132 to mate with the second barrier 18, and a center section 134 therebetween to seal the gap 12 between the barriers 14,18. The first section 130 and the second section 132 each preferably present a concave cross-section with two sidewalls 136 and a bight section 138 therebetween. As shown in FIG. 3, the transition 110 preferably presents a specific first shape with the first section 130 and the second section 132 each preferably presenting channels aligned at the angle between the joints 16,18. Thus, the barriers 14,16 can slide between the sidewalls 136 and engage the bight sections 138, thereby mating with and sealing to the first section 130 and the second section 132.

While the material 22 is flexible, it is typically not flexible enough to accommodate the first shape described above, without bunching up and/or ripping. Thus, the center section 134 must be adapted to accommodate the first shape. A preferred method of adapting the center section 134 requires cutting the material 22 near a longitudinal center with two inward cuts 140, as shown in FIG. 4. Each inward cut 140 is made from opposing longitudinal edges 142 and substantially perpendicular to the longitudinal edges 142. The inward cuts 140 preferably leave a middle portion of the center section 134 whole and continuous. The middle portion preferably aligns with the bight sections 138 and is preferably approximately as wide as the widest one of the joints 16,18. Thus, each inward cut 140 is preferably approximately one half of the difference between the width of the material 22 and the widest one of the joints 16,18. For example, if the joints 16,20 are both approximately two inches wide, then the width of the material 22 may be approximately four inches. In this case, each inward cut 140 would preferably be approximately one inch long, leaving the middle portion of the center section 134 and the bight sections 138 approximately two inches wide.

The sidewalls 136 are defined by the inward cuts 140 and comprise portions of the material 22 adjacent the longitudinal edges 142 extending inwardly for a width substantially equal to the length of the inward cuts 140. For example, if the inward cuts 140 are approximately one inch long, then the sidewalls 136 comprise approximately one inch wide portions adjacent the longitudinal edges 142. All four sidewalls 136 are preferably folded in a common direction, such that the material 22 presents a unitary channel structure. Then, the first section 130 is folded toward the second section 132 adjacent the inward cuts 140. It should be apparent, that as the first section 130 is folded toward the second section 132, portions of the sidewalls 136 begin to overlap. Once the first section 130 is aligned with the second section 132 at the angle between the joints 16,18, and thus the barriers 14,18, the portions of the sidewalls 136 adjacent the inward cuts 140 are preferably affixed together, such that the transition 110 may hold the first shape. The portions of the sidewalls 136 adjacent the inward cuts 140 may be affixed using mechanical fasteners, such as staples and or lacing anchors. Alternatively, the portions of the sidewalls 136 adjacent the inward cuts 140 may be affixed together using high temperature adhesives. Furthermore, the portions of the sidewalls 136 adjacent the inward cuts 140 may be sewn together.

Figure 6:
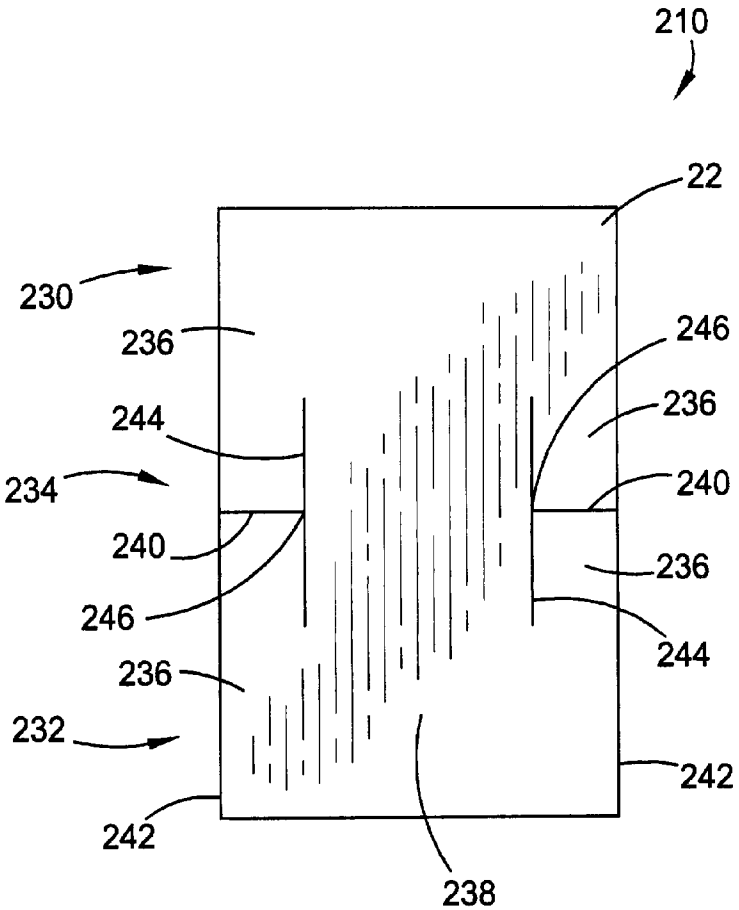
FIG. 6 is a plan view of a second piece of the material from which the second embodiment of the transition may be fabricated.
Figure 5:
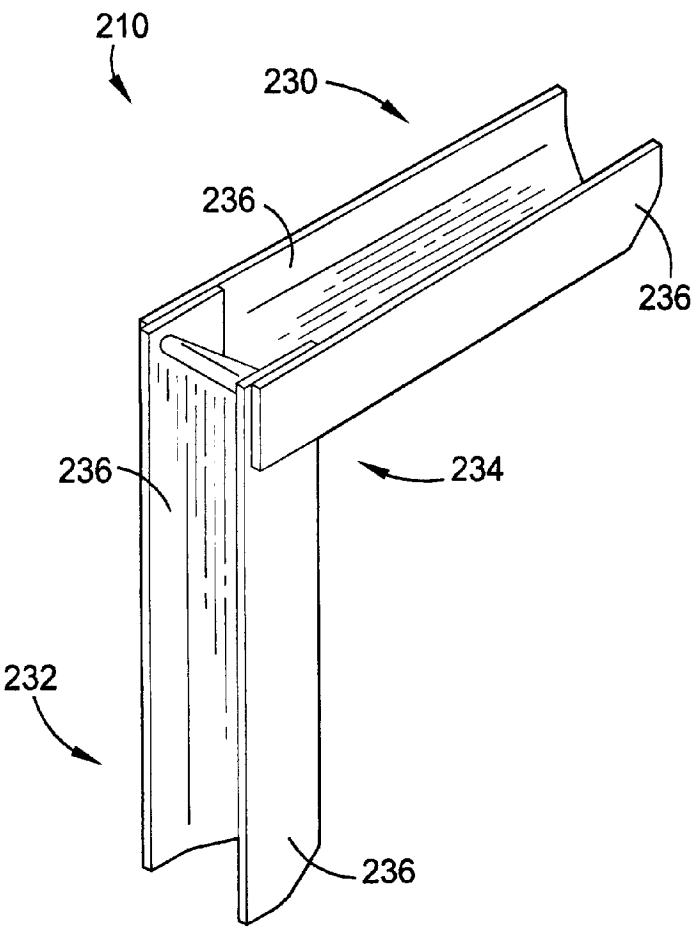
FIG. 5 is a perspective view of a second embodiment of the transition.

Referring also to FIGS. 5–6, a second embodiment of the transition 210 broadly comprises a first section 230 to mate with the first barrier 14, a second section 232 to mate with the second barrier 18, and a center section 234 therebetween to seal the gap 12 between the barriers 14,18. The first section 230 and the second section 232 each preferably present a convex cross-section with two sidewalls 236 and a bight section 238 therebetween. It can be seen that the second embodiment of the transition 210 is similar to the first embodiment of the transition 110. The most significant difference is that the first section 230 and the second section 232 of the second embodiment of the transition 210 each present convex cross-sections, and thus, a specific second shape, as shown in FIG. 5. It can be seen, that the second shape of the second embodiment of the transition 210 may engage the barriers 14,18 in a manner opposite to the first shape of the first embodiment of the transition 110.

For the reasons described above, the center section 234 must be adapted to accommodate the second shape. A preferred method of adapting the center section 234 requires cutting the material 22 near a longitudinal center with two inward cuts 240, as shown in FIG. 6. Each inward cut 240 is made from opposing longitudinal edges 242 and substantially perpendicular to the longitudinal edges 242. The inward cuts 240 preferably leave a middle portion of the center section 234 whole and continuous. The middle portion preferably aligns with the bight sections 238 and is preferably approximately as wide as the widest one of the joints 16,18. Thus, each inward cut 240 is preferably approximately one half of the difference between the width of the material 22 and the widest one of the joints 16,18. For example, if the joints 16,20 are both approximately three inches wide, then the width of the material 22 may be approximately five inches. In this case, each inward cut 240 would preferably be approximately one inch long, leaving the middle portion of the center section 234 and the bight sections 138 approximately three inches wide.

Additionally, one of two longitudinal cuts 244 is preferably made adjacent each inward end 246 of the inward cuts 240. The longitudinal cuts 244 are preferably substantially centered on the inward ends 246 and substantially parallel to the longitudinal edges 242. The longitudinal cuts 244 are preferably approximately twice as long as the inward cuts 240. In the above example, the longitudinal cuts 244 are preferably two inches long.

The sidewalls 236 are defined by the inward cuts 240 and comprise portions of the material 22 adjacent the longitudinal edges 242 extending inwardly for a width substantially equal to the length of the inward cuts 240. For example, if the inward cuts 240 are approximately one inch long, then the sidewalls 236 comprise one inch wide portions adjacent the longitudinal edges 242. All four sidewalls 236 are preferably folded in a common direction, such that the material 22 presents the unitary channel structure, similar to the first embodiment of the transition 110. Then, the first section 230 is folded away from the second section 232 adjacent the inward cuts 240 until a rear surface of the first section 230 meets a rear surface of the second section 232. At this point, the material 22 is in the shape of two parallel and opposing convex channels meeting at their bight sections 238. The material 22 is preferably affixed adjacent opposing pairs of ends of the longitudinal cuts 244, which should substantially meet. The material 12 may be affixed using the mechanical fasteners, the adhesives, or may be sewn together, as discussed above It should be apparent that this creates a tab between the first section 230 and the second section 232. While the tab preferably remains with the transition 210, the tab may be removed from the transition 210. If the tab is removed, the middle portion of the center section 234 may not be completely continuous. In this case, the middle portion of the center section 234 must rely on the manner in which the material 22 is affixed adjacent the ends of the longitudinal cuts 244, in order to effectively seal the gap 12.

Then, the first section 230 is folded toward the second section 232 adjacent the ends of the longitudinal cuts 244. It should be apparent, that as the first section 230 is folded toward the second section 232, portions of the sidewalls 236 begin to overlap. Once the first section 230 is aligned with the second section 232 at the angle between the joints 16,18, and thus the barriers 14,18, the portions of the sidewalls 236 adjacent the inward cuts 240 are preferably affixed together, such that the transition 210 may hold the second shape. The portions of the sidewalls 236 adjacent the inward cuts 240 may be affixed using the mechanical fastener, the adhesives, or may be sewn together, as discussed above.

Figure 8:
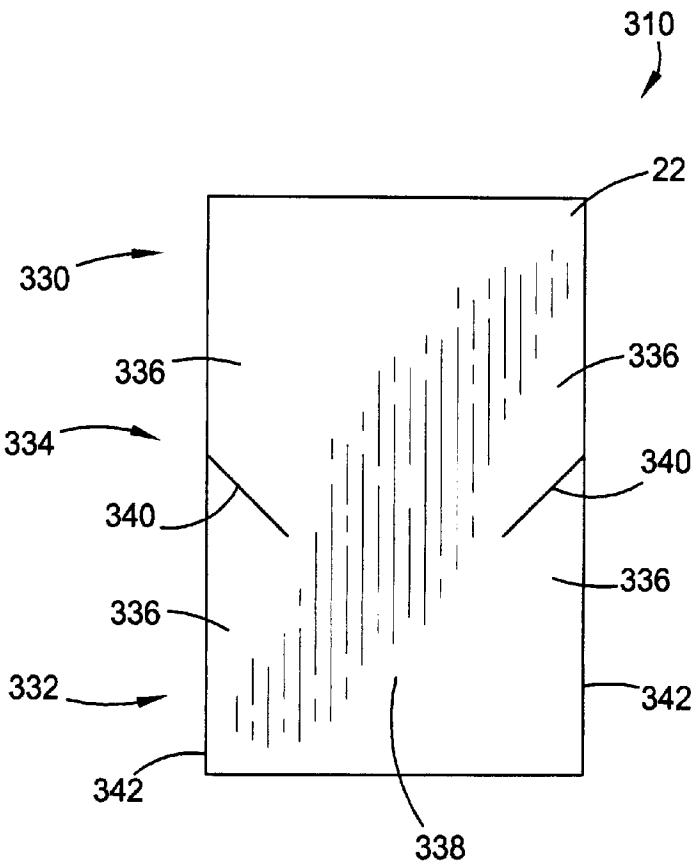
FIG. 8 is a plan view of a third piece of the material from which the third embodiment of the transition may be fabricated.
Figure 7:
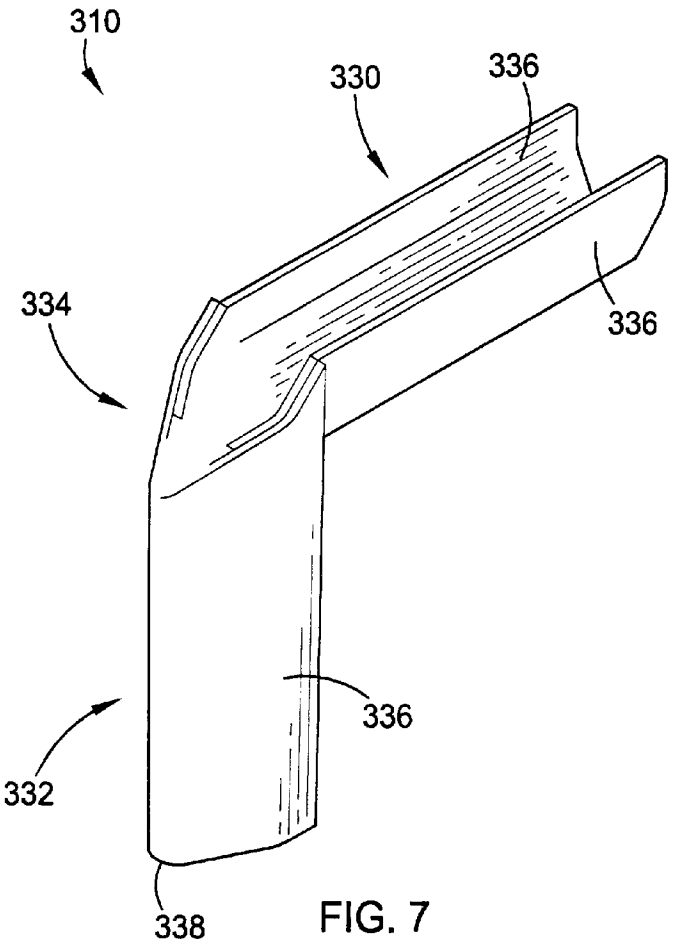
FIG. 7 is a perspective view of a third embodiment of the transition.

As shown in FIGS. 7–8, a third embodiment of the transition 310 broadly comprises a first section 330 to mate with the first barrier 14, a second section 332 to mate with the second barrier 18, and a center section 334 therebetween to seal the gap 12 between the barriers 14,18. The first section 330 preferably presents a convex cross-section with two sidewalls 336 and a bight section 338 therebetween. The second section 332 preferably presents a concave cross-section with two sidewalls 336 and a bight section 338 therebetween. Thus, the third embodiment of the transition 310 presents a specific third shape, as shown in FIG. 7. It can be seen that the third embodiment of the transition 310 essentially combines characteristics of the first and second embodiment of the transition 110,210.

For the reasons described above, the center section 334 must be adapted to accommodate the third shape. A preferred method of adapting the center section 334 requires cutting the material 22 near a longitudinal center with two inward cuts 340, as shown in FIG. 8. Each inward cut 340 is made from opposing longitudinal edges 342 at an approximately forty-five degree angle to the longitudinal edges 342 starting near the first section 330 and progressing inwardly toward the second section 332. The inward cuts 340 preferably leave a middle portion of the center section 334 whole and continuous. The middle portion preferably aligns with the bight sections 338 and is preferably approximately as wide as the widest one of the joints 16,18. Thus, each inward cut 340 is preferably approximately one half of the difference between the width of the material 22 and the widest one of the joints 16,18 multiplied by 1.414, which is the inverse of the cosine of the forty-five degree angle. For example, if the joints 16,20 are both approximately three inches wide, then the width of the material 22 may be approximately six inches. In this case, each inward cut 340 would preferably be approximately 2.1 inches long and extending into the material 22 approximately one and one half inch, leaving the middle portion of the center section 334 and the bight sections 338 approximately three inches wide.

The sidewalls 336 are defined by the inward cuts 340 and comprise portions of the material 22 adjacent the longitudinal edges 342 extending inwardly for a width substantially equal to the length of the inward cuts 340 divided by 1.414. For example, if the inward cuts 340 are approximately 2.1 inches long, then the sidewalls 336 comprise one inch wide portions adjacent the longitudinal edges 342. The sidewalls 336 of the first section 330 are preferably folded in a first direction, while the sidewalls 336 of the second section 332 are preferably folded in a second direction, opposite to the first direction, such that the material 22 presents two channel structures aligned end-to-end and opposed. Then, the first section 330 is folded toward the second section 332 adjacent the inward cuts 340. It should be apparent, that as the first section 330 is folded toward the second section 332, portions of the sidewalls 336 begin to overlap. Once the first section 330 is aligned with the second section 332 at the angle between the joints 16,18, and thus the barriers 14,18, the portions of the sidewalls 336 adjacent the inward cuts 340 are preferably affixed together, such that the transition 310 may hold the third shape. The portions of the sidewalls 336 adjacent the inward cuts 340 may be affixed using the mechanical fastener, the adhesives, or may be sewn together, as discussed above.

While the present invention has been described above, it is understood that other materials and/or dimensions can be substituted. Additionally, while the inward cuts 140,240,340 have been described as preferably near the longitudinal center of the longitudinal edges 142,242,343, the inward cuts 140,240,340 may be anywhere along the longitudinal edges 142,242,343. This modification would result in the first section 130,230,330 being offset with respect to the second section 132,232,332. This and other minor modifications are within the scope of the present invention.

In use, an installer may mate the transition 10 to the barriers 14,18 before installing the barriers 14,18 into the joints 16,20. In doing so, the installer may choose to secure the transition 10 to the barriers 14,18 using the mechanical fastener, the adhesives, or stitching. However, the installer is not required to secure the transition 10 to the barriers 14,18 allowing the joints 16,20 to hold the transition 10 in place. Alternatively, the installer may mate the transition 10 to the barriers 14,18 after the barriers 14,18 have been installed in the joints 16,20.

What is claimed is:

1. A fire barrier transition operable to seal a gap between a first fire barrier sized to fit into a first expansion joint and a second fire barrier sized to fit into a second expansion joint wherein the first fire barrier and the second fire barrier reside in different planes, the transition comprising:

a first section operable to overlap the first barrier;

a second section operable to overlap the second barrier; and a center section substantially continuous with the first and second sections, thereby operable to seal the gap between the barriers, wherein the center section presents an angle allowing the first section and the second section to reside in different planes.

2. The transition as set forth in claim 1, wherein the transition is constructed of a flexible fire resistant material.

3. The transition as set forth in claim 1, wherein the overlap of the first section is approximately ten inches, and the overlap of the second section is approximately ten inches.

4. The transition as set forth in claim 1, wherein the center section is substantially continuous with the first section and the second section and operable to span the first joint.

5. The transition as set forth in claim 1, wherein the center section is substantially continuous with the first section and the second section and operable to span a widest one of the joints.

6. The transition as set forth in claim 1, wherein each section has a convex cross-section.

7. The transition as set forth in claim 1, wherein each section has a concave cross-section.

8. The transition as set forth in claim 1, wherein the first section has a convex cross-section and the second section has a concave cross-section.

9. The transition as set forth in claim 1, wherein the first section is operable to receive support from the first fire barrier, and the second section is operable to receive support from the second fire barrier.

10. The transition as set forth in claim 1, wherein the center section includes a first portion overlapping a second portion, wherein the first portion is affixed to the second portion.

11. A fire barrier transition operable to seal a gap between a first fire barrier sized to fit into a first expansion joint and a second fire barrier sized to fit into a second expansion joint, the transition comprising:

a first section operable to overlap the first barrier;

a second section operable to overlap the second barrier; and a center section substantially continuous with the first and second sections, thereby operable to seal the gap between the barriers, wherein the center section includes inward cuts made from both longitudinal edges and is folded and affixed adjacent the inward cuts using a fastener selected from the group consisting of—staples, lacing anchors, wire pins, adhesives, and sewing line.

12. The transition as set forth in claim 11, wherein the inward cuts create two flexible flanges along each side of the center section, such that a first flange on each side of the center section extends to an end of the first section and a second flange along each side of the center section extends to an end of the second section, wherein the flanges on each side of the center section overlap and are affixed one to the other with a fastener selected from the group consisting of staples, lacing anchors, wire pins, adhesives, and sewing line.

13. The transition as set forth in claim 11, wherein the center section includes additional cuts that intersect inner ends of the inward cuts, wherein the inward cuts and the additional cuts create two flexible flanges along each side of the center section.

14. The transition as set forth in claim 13, wherein the additional cuts are substantially parallel with the longitudinal edges of the center section.

15. A fire barrier transition operable to seal a gap between a first fire barrier sized to fit into a first expansion joint and a second fire barrier sized to fit into a second expansion joint, the transition comprising:

a first section operable to overlap the first barrier;

a second section operable to overlap the second barrier; and a center section substantially continuous with the first and second sections, thereby operable to seal the gap between the barriers, wherein the center section includes inward cuts made from both longitudinal edges.

16. The transition as set forth in claim 15, wherein the center section further includes longitudinal cuts adjacent and substantially perpendicular to the inward cuts.

17. The transition as set forth in claim 15, wherein the center section presents an angle allowing the first and second sections to reside in different planes, and wherein the cuts create at least two flexible flanges along each side of the center section with one of the flanges extending to an end of the first section and one of the flanges extending to an end of the second section.

* * * * *